United States Patent [19]

Niskanen et al.

[11] Patent Number: 4,964,950

[45] Date of Patent: Oct. 23, 1990

[54] METHOD AND APPARATUS FOR DIVIDING AND UNITING THE FLOWS OF HIGH-CONSISTENCY FIBRE SUSPENSIONS

[75] Inventors: Toivo Niskanen, Hamina; Voitto Reponen, Karhula, both of Finland

[73] Assignee: A. Ahlstrom Corporation, Karhula, Finland

[21] Appl. No.: 898,204

[22] PCT Filed: Jan. 20, 1989

[86] PCT No.: PCT/FI86/00005

§ 371 Date: Aug. 20, 1986

§ 102(e) Date: Aug. 20, 1986

[87] PCT Pub. No.: WO86/04369

PCT Pub. Date: Jul. 31, 1986

[30] Foreign Application Priority Data

Jan. 24, 1985 [FI] Finland ..... 850307

[51] Int. Cl.[5] ..... F16L 55/18

[52] U.S. Cl. ..... 162/100; 162/57; 162/380; 137/597; 137/883; 366/150; 366/154; 366/155; 366/156

[58] Field of Search ..... 162/336, 338, 343, 380, 162/216, 158, 100, 246; 55/52; 137/883, 597; 366/154, 155, 156, 150

[56] References Cited

U.S. PATENT DOCUMENTS

| | | | |
|---|---|---|---|
| 2,504,140 | 4/1945 | Mill . | |
| 2,938,824 | 5/1960 | Richter | 162/246 X |
| 3,296,066 | 1/1967 | Green et al. | 162/338 |
| 3,411,986 | 11/1968 | Buchberger et al. | 162/246 |
| 3,432,384 | 3/1969 | Dahl | 162/338 |
| 3,622,450 | 11/1971 | Attwood et al. . | |
| 3,823,063 | 7/1974 | Callahan et al. | 162/336 X |
| 4,273,562 | 6/1981 | Niskanen | 55/52 |
| 4,688,590 | 8/1987 | Anderheggen et al. | 137/883 X |

FOREIGN PATENT DOCUMENTS 434169 3/1983 Sweden .

*Primary Examiner*—Peter Chin
*Assistant Examiner*—Thi Dang
*Attorney, Agent, or Firm*—Toren, McGeady & Associates

[57] ABSTRACT

A method and an apparatus for dividing and uniting flows of high-consistency fibre suspensions. To prevent clogging of the distributor the fibre suspension is caused to flow into a space unitting the inlet and the outlet flows, where a turbulent flow extending to the valves regulating the discharge flow is created. The distributor includes a vortex chamber provided with an inlet and outlets and with regulating valves connected to the outlets and disposed at a short distance from the outlets. According to a preferred embodiment of the the invention, a rotor provided with vanes is disposed in the vortex chamber.

4 Claims, 3 Drawing Sheets

METHOD AND APPARATUS FOR DIVIDING AND UNITING THE FLOWS OF HIGH-CONSISTENCY FIBRE SUSPENSIONS

The present invention relates to a method and an apparatus for dividing and uniting the flows of high-consistency fibre suspensions.

The pulp industry often requires that fibre suspension is conveyed from a vessel or a pipe continuously or intermittently divided evenly or in a desired manner to several different places, e.g. from a storage tank to two or more processing devices. When the consistency of the suspension is low, i.e. up to approx. 5 per cent, no problems arise, but when the consistency is higher there is little free liquid between the fibres and the fibres form a fibre network the situation is quite different.

When the consistency is high, e.g. from 8 to 15 per cent, the fibre suspension forms a strong fibre network and dividing and uniting fibre suspensions in a pipe line is often impossible without special measures. When a high-consistency fibre suspension arrives at a junction point in the pipe line, the fibre network may be too strong to be dispersed. It is possible that the fibre network sticks to a part of the pipe which results in precipitation and clogging of the pipe line. When one branch of the pipe line is not in use and is closed by a valve, the portion of the pipe preceding the valve is easily clogged and does not open when the valve is opened.

Because of the strong fibre networks, high-consistency pulp flows from branch pipes can not be combined in a pipe line. Without special measures the fibre networks prevent two flows of a smaller diameter from forming a flow with a larger diameter.

The above problems in dividing and uniting the flows are avoided by subjecting the flow to such an intensive field of shear forces that the bonds between the fibres are broken and a turbulent flow is created where no fibre networks preventing the division and combination of the suspensions exist. The shear forces can be created by the geometry of the junction point or by a rotor.

The object of the present invention is to provide a method and an apparatus by which the flow of a fibre suspension of the consistency of 5 to 20 per cent can be divided and united in a controlled manner.

The use of turbulence to disrupt fibre bonds is previously disclosed e.g. in Finnish Patent No. 51116 and Finnish patent application no. 781071.

The former of these publications discloses a pulp distributor connected to a sheet formation device in which the flow is accelerated in a tapering portion of a pipe and is caused to impinge at high speed against a wall which forces the flow radially outwards to the outlets disposed around the impingement area.

The latter of the publications discloses a device for removing pulp from a vessel in which a pump connected to the outlet of the pulp vessel is provided with a rotor extending into the vessel.

The main characteristic feature of the present invention is that the fibre suspension is caused to flow into a space uniting the inlet and the outlet flows in which space a vortex flow is created to prevent a still pocket like state of the suspension.

The vortex flow is preferably created by a rotor.

The apparatus for carrying out the invention is characterized by a vortex chamber provided with inlets and outlets.

The invention is described in detail below with reference to the accompanying drawings which illustrate preferred embodiments of the apparatuses for carrying out the method of the invention.

Figure 1:
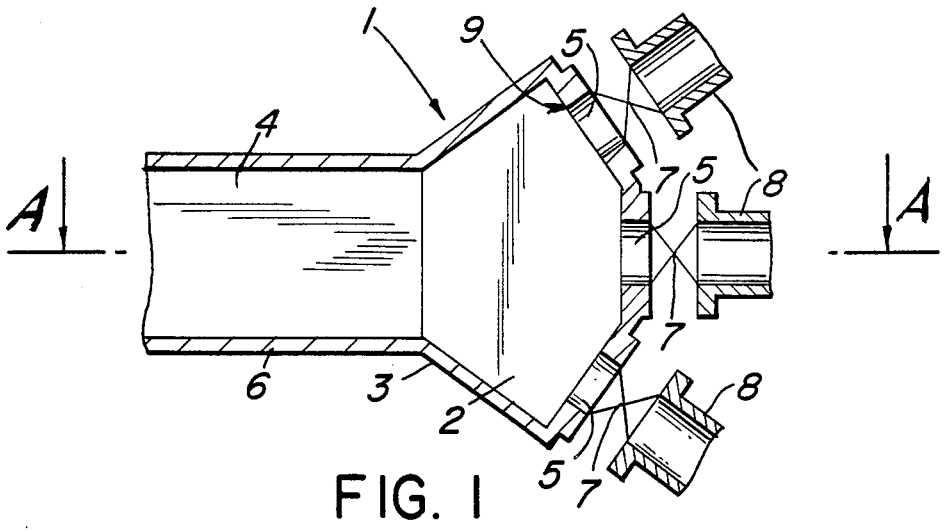
FIG. 1 is a longitudinal cross section along line B-B of the distributor of FIG. 2.
Figure 2:
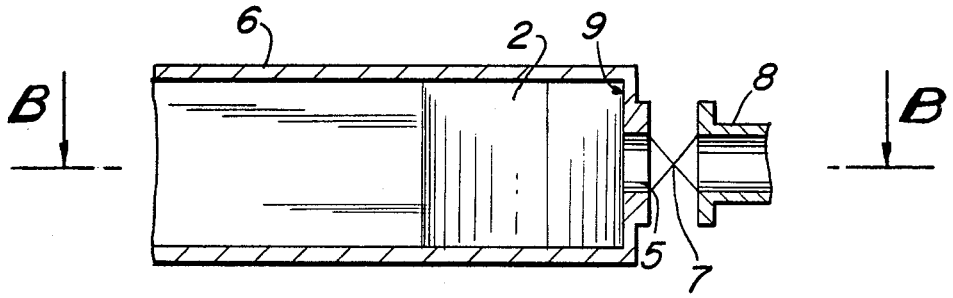
FIG. 2 is a section along line A—A of FIG. 1.

In the distributor 1 illustrated in FIGS. 1 and 2, the numeral 2 refers to a vortex chamber the wall 3 of which is provided with an inlet 4 and outlets 5. An inlet pipe 6 is connected to the inlet, the outlets are provided with regulating valves 7 to which outlet pipes 8 are connected. The regulating valves are disposed at a short distance from the inner surface 9 of the vortex chamber ($<d/2$, where d is the diameter of the outlet 5). Fibre suspension is supplied via the inlet pipe 6 at a high velocity ($>3$ m/s) to the vortex chamber 2 in which turbulence preventing the formation of fibre networks is created by the changes of direction caused by the small volume, the expansion of flow and the angular shape of the chamber even if some of the valves were closed. A major part of the kinetic energy of the fibre suspension is tranformed into turbulent energy. The higher the velocity of the inlet flow and the smaller the vortex chamber is, the greater is the intensity of the turbulence and its disrupting effect on the fibre bonds. Inner surface 9 surrounds each outlet 5 and extends substantially normally to a direction of flow of pulp through the outlet.

The fibre suspension is removed from the vortex chamber through the regulating valves and is supplied through the branch pipes 8 to process devices which are not illustrated. The valves can be used for regulating the fibre suspensions flows to the process devices as required. The diameter of the branch pipes can be equal, as illustrated in the drawings, or unequal. The vortex flow extending to the inlets of the valves prevents plugs from being formed in front of the valves when they are closed.

Figure 3:
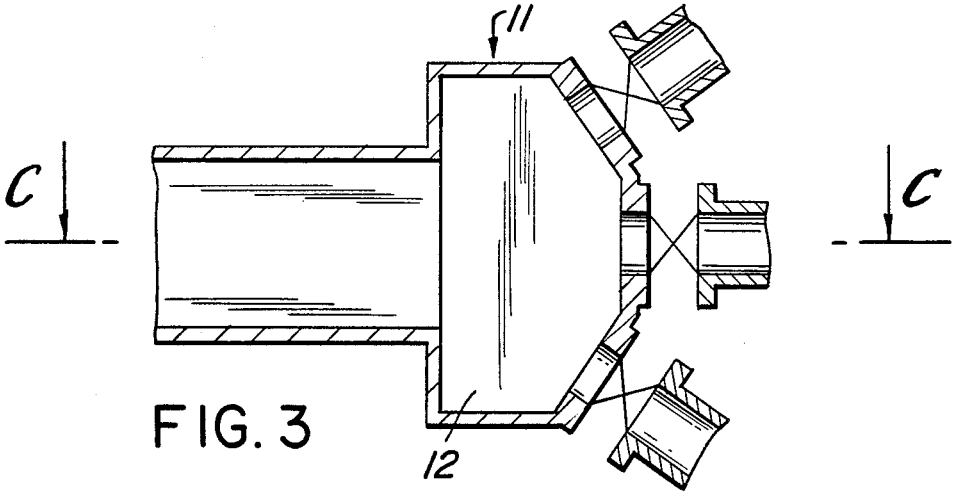
FIG. 3 is a section along line D—D of FIG. 4 illustrating an other embodiment of a distributor.
Figure 4:
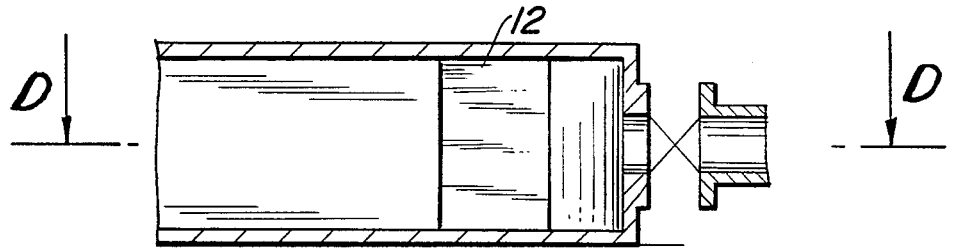
FIG. 4 is a section along line C—C of FIG. 3.

The distributor 11 illustrated in FIGS. 3 and 4 is equal to the embodiment of FIGS. 1 and 2 with the exception of its vortex chamber 12 the shape of which is different.

Figure 5:
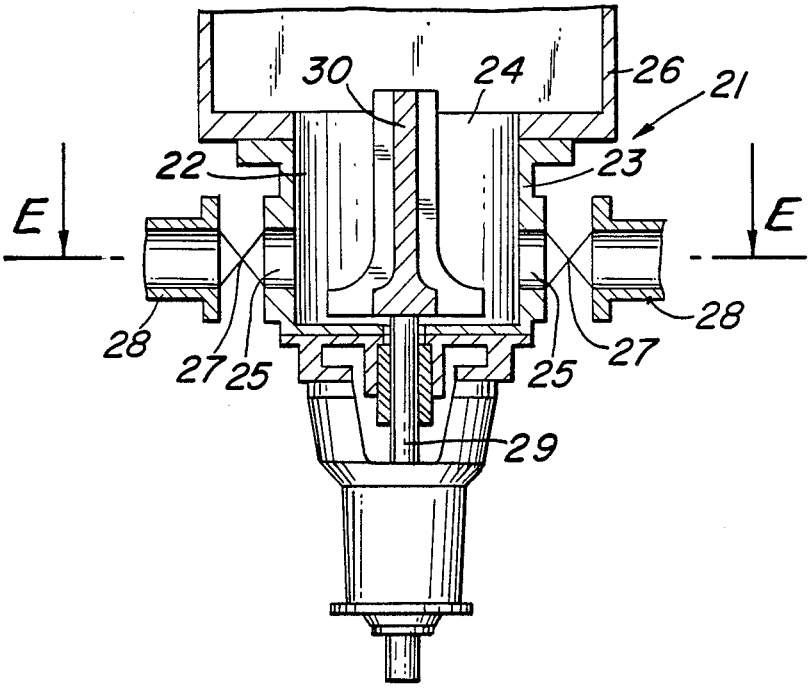
FIG. 5 is a section along line F—F of FIG. 6 illustrating a third alternative embodiment of a distributor.
Figure 6:
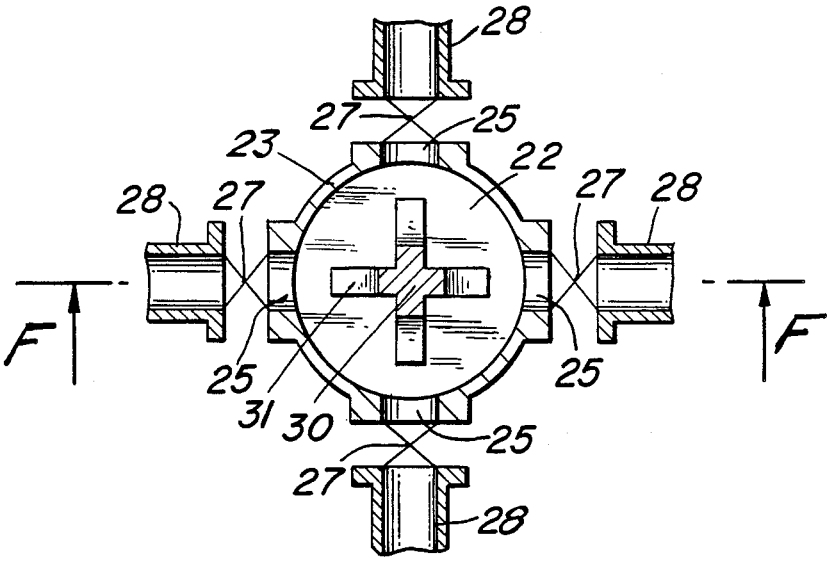
FIG. 6 is a section along line E—E of FIG. 5.

The distributor 21 illustrated in FIGS. 5 and 6 comprises a cylindrical vortex chamber 22 provided with an inlet 24 to which an inlet pipe 26 is connected. A vortex chamber wall 23 shows four outlets 25 disposed at an equal distance from each other, to which the outlet pipes 28 are connected through regulating valves 27. A rotor 30 provided with vanes 31 is disposed in the vortex chamber. The shaft 29 of the rotor is mounted on bearings and the rotor rotated by known methods.

The desired turbulent flow is created by rotating the rotor. The range of the rotor is approx. 6 R where R is the distance of the vane outer edge from the shaft center line.

Figure 7:
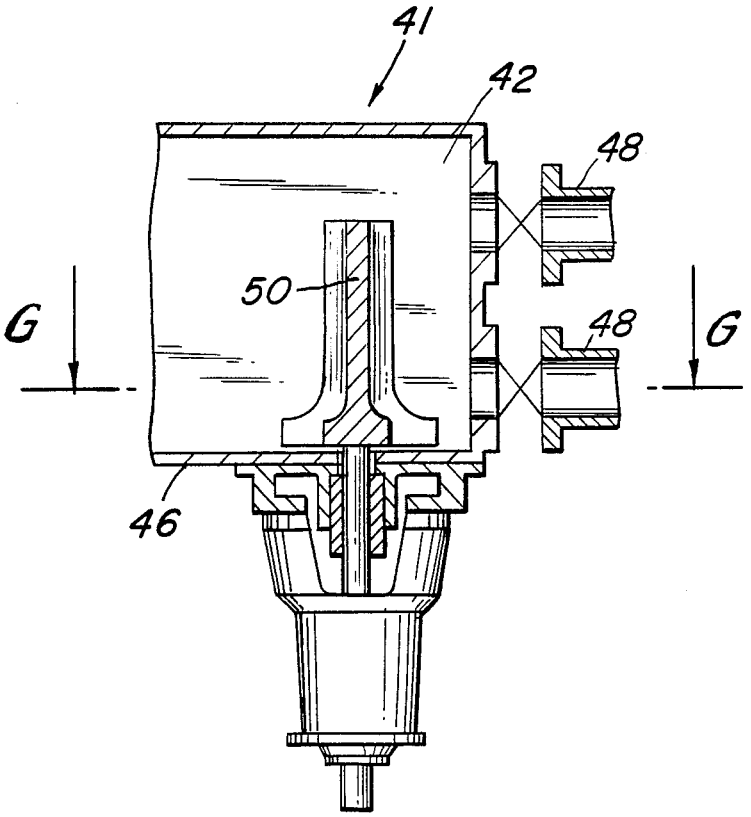
FIG. 7 is a section along line H—H of FIG. 8 illustrating a fourth embodiment of a distributor.
Figure 8:
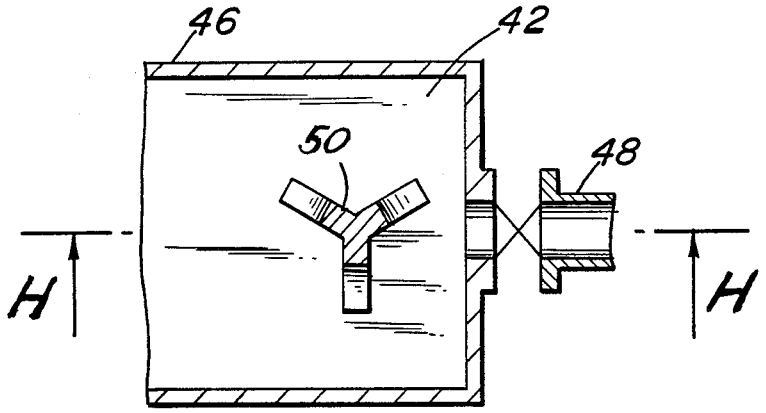
FIG. 8 is a section along line G—G of FIG. 7.

In the distributor 41 illustrated in FIGS. 7 and 8 the position of the inlet pipe 46 and the outlet pipe 48 in relation to the rotor 50, and the shape of the vortex chamber 42 and the rotor are different from those of the embodiment illustrated in FIGS. 5 and 6, but its operation principle is the same.

The invention is also applicable for feeding several fibre suspension flows into a vortex chamber and discharging them as one flow.

The invention is not limited by the embodiments illustrated here as examples only, but it can be applied and modified within the scope of protection defined by the patent claims. E.g. an apparatus according to the invention may comprise a plurality of inlet pipes and a plurality of outlet pipes.

We claim:

1. A method for dividing and uniting flows of high consistency fibre suspensions, comprising:

supplying the fibre suspension, having a consistency of between 5%–20% to a vortex chamber having a distributor space therein with at least one inlet opening and a plurality of outlet openings for uniting inlet and outlet flows through the distributor space, said inlet and outlet openings being spaced from each other;

providing a plurality of outlet channels each connected to one of said outlet openings and extending outwardly from said distributor space;

providing said distributor space with an inner surface around each outlet opening which forms an edge in said surface between said outlet opening and said outlet channel connected to that outlet opening which is sharp and substantially non-rounded;

creating turbulent flow by means of angularly disposed interior surface in the distributor space so that the fibre suspension is subjected to shear forces for dividing the fibre suspension for flow out of said outlet openings, and positioning each valve at a distance of less than one-half the diameter of an outlet opening away from said distributor space.

2. An apparatus for dividing and uniting flows of high-consistency fibre suspensions, having the consistency of between about 5%–20%, comprising:

a vortex chamber for distributing said fibre suspension, said vortex chamber including at least one inlet opening and a plurality of outlet openings, said inlet and outlet openings all being spaced from each other;

an inlet channel connected to said at least one inlet opening and extending outwardly from said vortex chamber;

a plurality of outlet channels each connected to one of said outlet openings and extending outwardly from said vortex chamber;

inner surfaces of said vortex chamber around each of said outlet openings forming a sharp angle with each of said outlet channels, edges between said surfaces and said outlet channels being non-rounded so that a major part of the kinetic energy of the suspension flowing through said vortex chamber is converted into turbulent energy; and a regulating valve connected to each of said outlet channels at a short distance from each respective outlet opening, selected ones of said regulating valves being closed for regulating the flow of the suspension through said vortex chamber, a rotor mounted for rotation about an axis in said vortex chamber for increasing the turbulence of the suspension in said vortex chamber, said rotor includes a plurality of vanes extending radially of said axis, said axis extending substantially transversely to each of said outlet channels, said axis of said rotor extends axially of said vortex chamber, each of said valves are positioned less than one-half the diameter of a respective outlet opening, away from an inner surface of said vortex chamber.

3. An apparatus according to claim 2, wherein each vane of said rotor has a radius from an outer tip of said vane to the axis of said rotor, said rotor having an axial length equal to about six times the radius.

4. An apparatus for dividing and uniting flows of high-consistency fibre suspensions, having the consistency of between about 5%–20%, comprising:

a vortex chamber for distributing said fibre suspension, said vortex chamber including at least one inlet opening and a plurality of outlet openings, said inlet and outlet openings all being spaced from each other;

an inlet channel connected to said at least one inlet opening and extending outwardly from said vortex chamber;

a plurality of outlet channels each connected to one of said outlet openings and extending outwardly from said vortex chamber;

inner surfaces of said vortex chamber around each of said outlet openings forming a sharp angle with each of said outlet channels, edges between said surfaces and said outlet channels being non-rounded so that a major part of the kinetic energy of the suspension flowing through said vortex chamber is converted into turbulent energy; and a regulating valve connected to each of said outlet channels at a short distance from each respective outlet opening, selected ones of said regulating valves being closed for regulating the flow of the suspension through said vortex chamber, each said valve is positioned at a location which is less than one-half the diameter of an outlet opening away from an inner surface of said vortex chamber.

* * * * *

UNITED STATES PATENT AND TRADEMARK OFFICE

CERTIFICATE OF CORRECTION

PATENT NO. : 4,964,950

DATED : Oct. 23, 1990

INVENTOR(S) : Toivo Niskanen and Voitto Reponen

It is certified that error appears in the above-identified patent and that said Letters Patent is hereby corrected as shown below:

Title page change:

"[22] PCT Filed: Jan. 20, 1989" to
--[22] PCT Filed: Jan. 20, 1986--.

Signed and Sealed this

Eighth Day of September, 1992

*Attest:*

DOUGLAS B. COMER

*Attesting Officer*

*Acting Commissioner of Patents and Trademarks*